US006833821B2

(12) United States Patent
Amano et al.

(10) Patent No.: US 6,833,821 B2
(45) Date of Patent: Dec. 21, 2004

(54) 3-DIMENSIONAL WAVE-GUIDING STRUCTURE FOR HORN OR TUBE-TYPE WAVEGUIDES

(75) Inventors: Osamu Amano, Yokohama (JP); Akihito Watanabe, Fukui (JP)

(73) Assignees: Sakase Adtech Co., Fukui (JP); NEC Toshiba Space Systems, Ltd., Yokohama (JP)

( * ) Notice: Subject to any disclaimer, the term of this patent is extended or adjusted under 35 U.S.C. 154(b) by 0 days.

(21) Appl. No.: 10/388,595

(22) Filed: Mar. 17, 2003

(65) Prior Publication Data

US 2004/0183738 A1 Sep. 23, 2004

(51) Int. Cl.[7] ..... H01Q 1/36; H01Q 13/00
(52) U.S. Cl. ..... 343/897; 343/772; 343/786
(58) Field of Search ..... 343/897, 912, 343/915, DIG. 2, 772, 786; 442/204, 205; 428/408

(56) References Cited

U.S. PATENT DOCUMENTS

| | | | | |
|---|---|---|---|---|
| 5,686,930 A | * | 11/1997 | Brydon | 343/912 |
| 5,702,993 A | * | 12/1997 | Kubomura et al. | 442/204 |
| 6,154,185 A | * | 11/2000 | Watanabe | 343/897 |
| 2004/0009728 A1 | * | 1/2004 | Kubomura et al. | 442/205 |

OTHER PUBLICATIONS

Osamu Amano et al., *Development of super–lightweight waveguide for MUSES–C XHGA and horn antennas for MUSES–C XMGA*, Proceedings of 7$^{th}$ Japan International SAMPE, Symposium & Exhibition, Nov. 13–16, 2001.

* cited by examiner

*Primary Examiner*—Hoang V. Nguyen
(74) *Attorney, Agent, or Firm*—Westerman, Hattori, Daniels & Adrian, LLP

(57) ABSTRACT

The present invention provides a 3-dimensional wave-guiding structure for horn or tube-type waveguides. The wave-guiding structure comprises a fiber-reinforced composite material and a conductive nonwoven fabric shaped together with the composite material. The present invention also provides a 3-dimensional wave-guiding structure comprising a conductive nonwoven fabric 30 and a fiber-reinforced triaxial woven fabric 20 which are laminated alternately or in an arbitrary order. The conductive nonwoven fabric having flexibility can be readily shaped together with the composite material composed of a triaxial woven fabric or the like in conformity with the 3-dimensional shape of various horn or tube-like waveguides such as a waveguide diplexer, waveguide circulator, hybrid waveguide and waveguide directional coupler to provide a lightweight wave-guiding structure capable of achieving both excellent mechanical and electrical characteristics.

2 Claims, 3 Drawing Sheets

Radiation Pattern of CFRP Waveguide Horn (ø = 0°)
Opening Diameter 90 x 130 mm Flare Length 160 mm
Frequency 7.156 GHz
Coverage ±9° x ±12.5° Gain 13.7 dB and above Radiation Pattern of CFRP Waveguide Horn (ø = 90°)
Opening Diameter 90 x 130 mm Flare Length 160 mm
Frequency 7.156 GHz
Coverage ±9° x ±12.5° Gain 13.9 dB and above Radiation Pattern of CFRP Waveguide Horn (ø = 0°)
Opening Diameter 90 x 130 mm Flare Length 160 mm
Frequency 8.408 GHz
Coverage ±9° x ±12.5° Gain 14.0 dB and above Radiation Pattern of CFRP Waveguide Horn (ø = 90°)
Opening Diameter 90 x 130 mm Flare Length 160 mm
Frequency 8.408 GHz
Coverage ±9° x ±12.5° Gain 14.0 dB and above

3-DIMENSIONAL WAVE-GUIDING STRUCTURE FOR HORN OR TUBE-TYPE WAVEGUIDES

FIELD OF THE INVENTION

The present invention relates to a 3-dimensional wave-guiding structure for use in horn-type or tube-type waveguides to guide electromagnetic waves in high frequency range, particularly in extremely high frequency range.

BACKGROUND OF THE INVENTION

Heretofore, a horn or tube-type waveguide has been made of metal to provide electrical characteristics therein. The shape of the waveguide should be exactly maintained in its entirety to allow electromagnetic waves to be effectively guided along a 3-dimensional channel formed therein. If the waveguide is made only of metal to assure adequate strength/rigidity for the above purpose, the waveguide will inevitably have an excessively increased weight, which leads to deteriorated operationality in a large-size movable waveguide such as double-ridge guide horn antennas. Thus, it has been desired to achieve weight reduction in the waveguide. In particular, the severe lightweight requirement of space satellites has not been ever impossible to be cleared by the conventional metal waveguide.

Recently, it has been developed a new laminated structure prepared by adhesively attaching a metal film such as a metallic foil onto a fiber-reinforced composite material or by plating a certain metal over the fiber-reinforced composite material to achieve the structural strength/rigidity by the lightweight composite material and provide the electrical characteristics by a metal layer formed thereon.

According to this laminated structure, a lightweight waveguide with excellent electrical characteristics can be theoretically obtained while assuring and maintaining the shape/mechanical strength and the electrical characteristics required for horn or tube-type waveguides by the composite material and the metal layer, respectively.

However, when a certain metal is plated on the surface of the composite material formed in a given shape, it is actually difficult to plate the metal uniformly over the composite material and form a metal layer with an even thickness, particularly in a waveguide having a 3-dimensional complicated shape, because the shaped composite material generally has an extremely large surface area, while a processing bath or chamber is practically limited in volume irrespective of whether the plating is a wet or dry processing. In addition, if the metal layer is formed through a wet plating process, the composite material can be undesirably corroded by a plating solution, or the plating solution can be undesirably absorbed in the composite material.

In the structure prepared by adhesively attaching or laminating a metal film onto the composite material, the composite material and the metal film are not always attached together with a sufficient adhesive or cohesive force. Thus, the laminated structure can be deformed due to mechanical load, or the metal film can be peeled off due to strong vibrations. In addition, the deterioration of the cohesive force inevitably causes the peeling of the metal film.

Further, when a metal film is adhesively attached onto the composite material formed as a horn or tube-type waveguide including 3-dimensionally curved surfaces along its channel for guiding electromagnetic waves, the metal film cannot be shaped in conformity to the 3-dimensionally curved surfaces in advance. Thus, an electrically continuity has been hardly maintained over the entire 3-dimensionally curved surfaces through the technique of adhesively attaching the metal film.

In particular, a plenty of waveguide components, such as a waveguide diplexer, waveguide circulator, hybrid waveguide and waveguide directional coupler, are provided with a 3-dimensional hollow structure which serves as a channel for guiding electromagnetic waves and includes bent and branched portions having 3-dimensionally curved surfaces. Therefore, the waveguide prepared through the above conventional technique has a limited range of applications.

SUMMARY OF THE INVENTION

In view of the above problems, it is therefore an object of the present invention to provide a wave-guiding structure capable of assuring excellent electrical characteristics required for horn or tube-type waveguides while maintaining desired mechanical strength in combination with a composite material.

In order to achieve this object, according to a first aspect of the present invention, there is provided a 3-dimensional wave-guiding structure for horn or tube-type waveguides, comprising a fiber-reinforced composite material and a conductive nonwoven fabric shaped together with the composite material.

According to a second aspect of the present invention, there is provided a 3-dimensional wave-guiding structure for horn or tube-type waveguides, comprising a conductive nonwoven fabric and a fiber-reinforced triaxial woven fabric which are laminated alternately or in an arbitrary order and shaped together.

In the present invention, a horn or tube-type waveguide can be formed by laminating a fiber-reinforced composite material and a conductive nonwoven fabric together to provide a desired mechanical strength by the composite material and assure electrical characteristics required for the waveguide structure by the conductive nonwoven fabric. The laminated structure may be obtained by laminating a conductive nonwoven fabric and a pre-preg comprising a resin-impregnated fiber-reinforced woven fabric alternately or in an arbitrary order or combination, attaching them together under heat and compression, and shaping them together.

The conductive nonwoven fabric is formed by combing fine fibers. The resulting flexibility allows the conductive nonwoven fabric to be readily formed in a complicated shape for a horn or tube-type waveguides while maintaining its mesh structure. In addition, the mesh structure allows the conductive nonwoven fabric to be impregnated commonly with the resin impregnated in the fiber-reinforced composite material so as to form an integral structure. For example, in a laminated structure including the conductive nonwoven fabric sandwiched between the fiber-reinforced pre-pregs, the conductive nonwoven fabric can be sufficiently integrated with the fiber-reinforced pre-pregs disposed on the front and back surfaces thereof. Thus, even in a laminated structure having plural sets of such laminated layers, a desirable strength can be maintained without any peeling of the layers.

The conductive nonwoven fabric may be a nonwoven fabric comprising metal fibers or metallized fibers, or a metallized nonwoven fabric obtained by depositing metal on a nonwoven fabric. The electrical characteristics, such as conductivity, required for horn or tube-type waveguides, may be achieved by selecting the type of the metal or the diameter of the fiber or by adjusting the density the conductive nonwoven fabric based on the porosity or thickness thereof depending on electromagnetic wavelength to be guided.

While the fiber-reinforced composite material is not limited to a specific structure, it preferably comprises a fiber-reinforced woven fabric, more preferably a fiber-reinforced triaxial woven fabric, to provide an accurate horn or tube-type waveguide having anisotropy in mechanical characteristics and/or thermal expansion without distortion otherwise caused during shaping process.

The laminated structure may be a symmetrically laminated structure including one or more conductive nonwoven fabrics, such that the triaxial woven fabric/the conductive nonwoven fabric/the triaxial woven fabric, or the conductive nonwoven fabric/the triaxial woven fabric/the conductive nonwoven fabric are laminated in this order. The structure having the nonwoven fabric sandwiched between the triaxial woven fabrics can minimize thermal distortion to be caused in the laminated structure. The conductive nonwoven fabric can be sandwiched between appropriate triaxial woven fabrics to provide a high cohesive strength therebetween.

The textured structure of the triaxial woven fabric has hexagonal through-holes penetrating the front and back surfaces of the structure. The triaxial woven fabric can be texturized so as to adjust the respective sizes of the through-holes to provide an electrical conduction between the conductive nonwoven fabrics sandwiching the triaxial woven fabric on its front and back surfaces. According to the above structure, both mechanical and electrical characteristic can be adjustably improved by stacking up an appropriate number of the fiber-reinforced triaxial woven fabrics and the conductive nonwoven fabrics.

The conductive nonwoven fabric has flexibility allowing it to be handled as with the fiber-reinforced pre-preg. Thus, the process of attaching the conductive nonwoven fabric and the composite material under heat and compression to form a horn or tube-type waveguide may be used any commonly used method in the field of fiber-reinforced composite materials.

DESCRIPTION OF THE PREFERRED EMBODIMENT

Figure 1A:
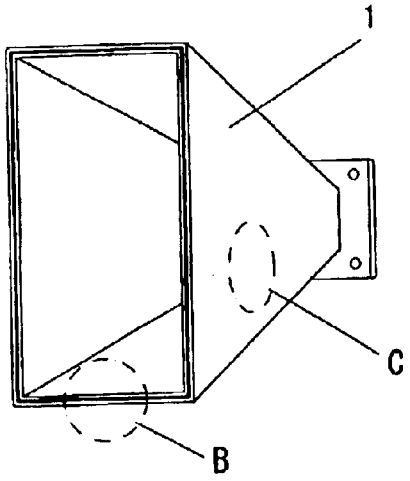
FIG. 1(A) is a perspective view showing a horn-type waveguide according to one embodiment of the present invention.
Figure 1B:
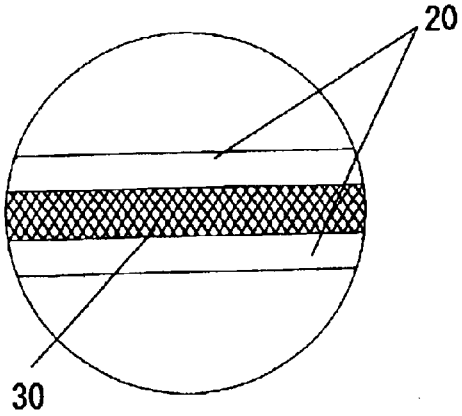
FIG. 1(B) is an enlarged view of the end surface of the waveguide in FIG. 1(A).
Figure 1C:
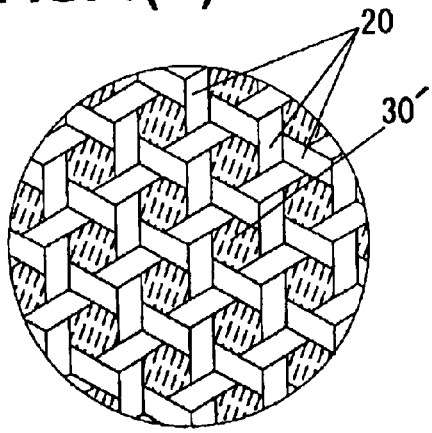
FIG. 1(C) is an enlarged view of the side surface of the waveguide in FIG. 1(A).
Figure 2A:
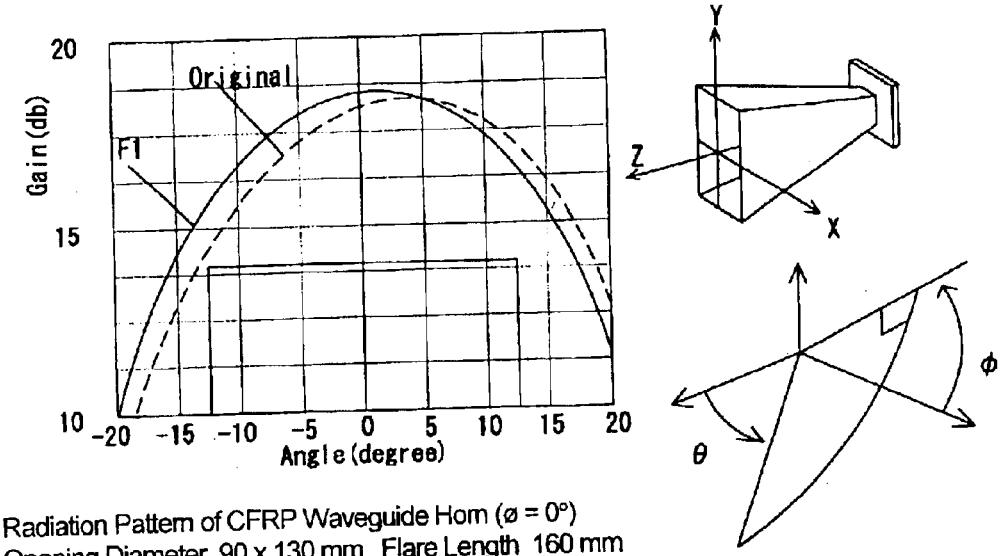
FIGS. 2(A) and 2(B) show respective electrical characteristics of two types of horn-type waveguides according to embodiments of the present invention.
Figure 2B:
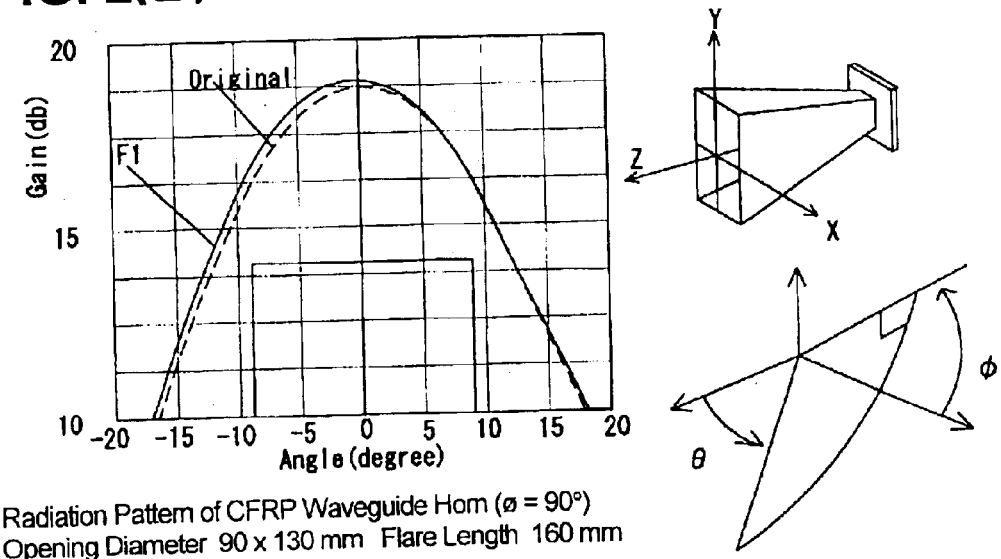
Figure 3A:
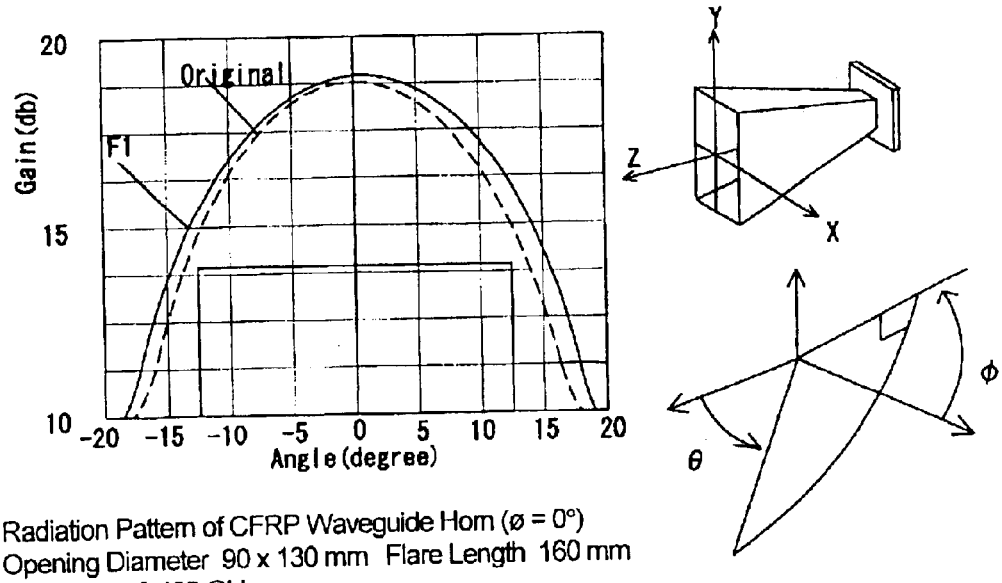
FIGS. 3(A) and 3(B) show respective electrical characteristics of the horn-type waveguides in FIGS. 2(A) and 2(B) at a different frequency.
Figure 3B:
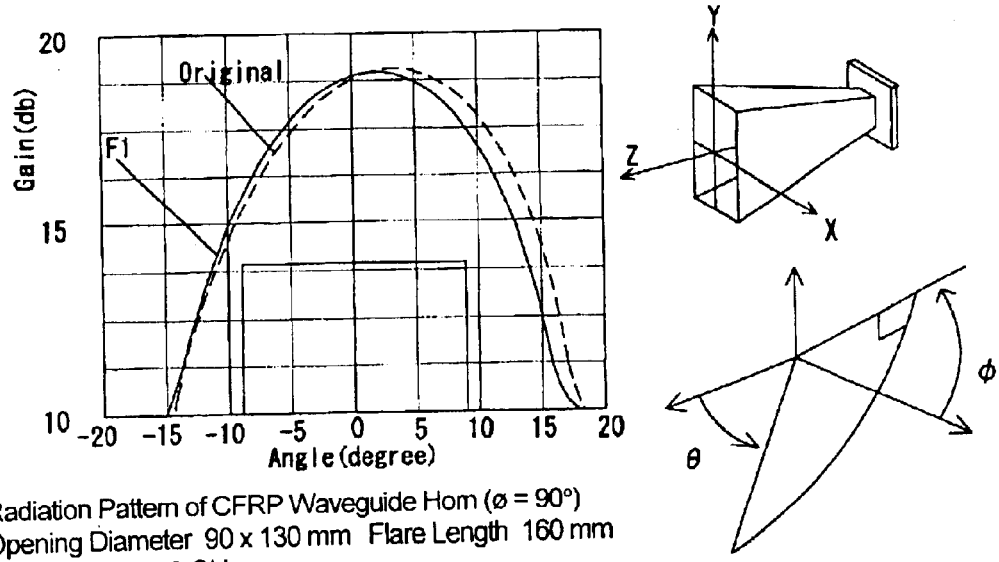

FIGS. 1(A), 1(B) and 1(C) show a horn-type waveguide according to one embodiment of the present invention. FIG. 1(A) is a perspective view showing the appearance of the horn-type waveguide, and FIG. 1(B) is an enlarged view of the end surface of the waveguide. As shown in FIG. 1(B), the section of the waveguide has a structure in which conductive fibers 30 are sandwiched by a pair of fiber-reinforced triaxial woven fabrics 20, 20, and they are integrally laminated together under heat and compression.

FIG. 1(C) is an enlarged view of the exposed side surface of the waveguide. As shown in FIG. 1(C), the textured structure of the fiber-reinforced triaxial woven fabric 20 has a plurality of through-holes penetrating the front and back surfaces thereof. Thus, this laminated structure is staked up in a plural number, the conductive nonwoven fabric 30'can be connected with another adjacent conductive nonwoven fabric through the through-holes to maintain an excellent cohesiveness between the layers.

In the 3-dimensional wave-guiding structure of the present invention, the conductive nonwoven fabric is structurally integrated with the composite material or fiber-reinforced triaxial woven fabric. As might be expected, in a 180-degree peel test of a waveguide using a copper fiber nonwoven fabric as the conductive nonwoven fabric, no peeling was caused through material breakdown in the copper fiber nonwoven fabric. In a thermal shock test under the condition that the waveguide was transferred from an oven at +180° C. to liquid nitrogen at −195° C., no peeling was caused between the triaxial woven composite material the copper fiber nonwoven fabric. Table 1 shows the result of a peel test for a waveguide comprising a copper fiber nonwoven fabric and a carbon fiber-reinforced composite material.

TABLE 1

Result of Peel Test for Conductive Substrate/Fiber-Reinforced Substrate

| No. | Conductive Substrate | Fiber-Reinforced Substrate | Peel Strength (kN/m) Blank | Peel Strength (kN/m) After thermal shock |
|---|---|---|---|---|
| 1 | Copper foil t = 30 μm | Unidirectional pre-preg | 0.174 | 0.337 |
| 2 | Copper foil t = 30 μm | Bi-Plain triaxial woven fabric pre-preg | 0.121 | 0.239 |
| 3 | Copper foil t = 30 μm | Basic triaxial woven fabric pre-preg | 0.093 | 0.056 |
| 4 | Copper foil t = 30 μm | Plain biaxial woven fabric pre-preg | 0.139 | 0.000 |
| 5 | Punching copper foil t = 30 μm | Bi-Plain triaxial woven fabric pre-preg | 0.209 | 0.127 |
| 6 | Copper fiber-sintered nonwoven fabric 50 g/m$^2$ | Unidirectional pre-preg | Non Peel | Non Peel |
| 7 | Copper fiber-sintered nonwoven fabric 50 g/m$^2$ | Bi-Plain triaxial woven fabric pre-preg | Non Peel | Non Peel |
| 8 | Copper fiber-sintered nonwoven fabric 100 g/m$^2$ | Basic triaxial woven fabric pre-preg | Non Peel | Non Peel |

Fiber-Reinforced Substrate: T 300 class carbon fibers
Pre-Preg: epoxy resin-impregnated pre-preg FIGS. 2(A) and 2(B) and FIGS. 3(A) and 3(B) show measurement results of electrical characteristics of horn-type waveguides of the present invention which comprises CFRP carbon fiber-reinforced composite material).

As seen in the characteristic curves of these figures, at both frequencies, the horn-type waveguides of the present invention exhibit substantially the same excellent electrical characteristics as those of original or conventional brass waveguide having the same dimensions.

The conductive nonwoven fabric and the fiber-reinforced composite material constituting the 3-dimensional wave-guiding structure of the present invention are not limited to the above embodiment, but the same effect can be obtained from the following combinational structures.

The material of the conductive nonwoven fabric may include: a metal fiber such as a copper fiber, silver fiber, gold fiber or stainless steel fiber-sintered nonwoven fabric; a metal plated fiber prepared by plating metal over any suitable fiber such as an aramid fiber, PBO fiber, glass fiber or carbon fiber; or a metal plated nonwoven fabric prepared by plating metal over a nonwoven fabric comprising aramid fibers, PBO fibers, glass fibers or carbon fibers.

Any other suitable fiber capable of providing conductivity and being formed as a nonwoven fabric may be used as material of the conductive nonwoven fabric.

While the fiber reinforced composite material for providing the mechanical characteristics of the waveguide may be commonly used fiber reinforced composite materials, a fiber-reinforced resin composite material comprising a tri-axial woven fabric using continuous or long fibers is particularly preferable. The structure of the triaxial woven fabric has a symmetric property which resists against deformation in the shape of a formed waveguide due to temperature changes or loads from mechanical stresses, and allows the waveguide to be returned to its original designed shape after the loads are removed, so as to provide excellent shape stability.

The fiber for use in the triaxial woven fabric may include an aramid fiber, PBO fiber, glass fiber or carbon fiber. The triaxial woven fabric may have a 16 to 64 gauge, Basic Bi-plain, triaxial woven fabric structure.

While matrix resin for used in the fiber-reinforced composite material may include epoxy resin and cyanate ester resin, it is understood that the matrix resin is not limited to such a material because it is selected in consideration of an intended purpose or the advisability in terms of the combination with reinforcing fibers.

The combinational structure of the conductive nonwoven fabric and the fiber-reinforced resin composite material may be prepared by simply superimposing one conductive nonwoven fabric onto one fiber-reinforced resin composite material, or by sandwiching one or more conductive nonwoven fabrics between the same kind of fiber-reinforced resin composite materials, respectively, or by sandwiching one or more conductive nonwoven fabrics between one or more different kinds of fiber-reinforced resin composite materials, respectively. Further, the wave-guiding structure of the present invention may be prepared by laminating one or more triaxial woven fabrics and one or more nonwoven fabrics, and then plating metal over the laminated structure.

As mentioned above, the wave-guiding structure of the present invention has both excellent mechanical and electrical characteristics. Thus, the wave-guiding structure has a wide range of applications such as a waveguide diplexer, waveguide circulator, hybrid waveguide and waveguide directional coupler as well as a waveguide horn.

What is claimed is:

1. A 3-dimensional wave-guiding structure for horn or tube-type waveguides, comprising a fiber-reinforced composite material including a conductive nonwoven fabric, wherein said wave-guiding structure is formed and shaped to have a multiple-reflection channel with a closed-loop shape in vertical section.

2. A 3-dimensional wave-guiding structure for horn or tube-type waveguides, comprising a composite material including a conductive nonwoven fabric and a fiber-reinforced triaxial woven fabric, wherein said conductive nonwoven fabric and said fiber-reinforced triaxial woven fabric are laminated alternately or in an arbitrary order and shaped together to have a multiple-reflection channel with a closed-loop shape in vertical section.

* * * * *